US005188519A

United States Patent [19]

Spulgis

[11] Patent Number: 5,188,519

[45] Date of Patent: Feb. 23, 1993

[54] SATURATED FLUID PUMPING APPARATUS

[75] Inventor: Ivars S. Spulgis, Columbus, Ohio

[73] Assignee: CVI Incorporated, Columbus, Ohio

[21] Appl. No.: 728,461

[22] Filed: Jul. 11, 1991

[51] Int. Cl.[5] ..... F04B 7/00

[52] U.S. Cl. ..... 417/511; 417/513

[58] Field of Search ..... 417/511, 520, 510, 513

[56] References Cited

U.S. PATENT DOCUMENTS

| | | | |
|---|---|---|---|
| 1,039,757 | 10/1912 | Kitton | 417/513 |
| 1,357,624 | 11/1920 | Drew | 417/511 |
| 2,815,719 | 12/1957 | Mustillo et al. | 417/511 |
| 3,335,673 | 8/1967 | Forrest | 417/511 |
| 4,792,289 | 12/1988 | Nieratschker | 417/511 |

FOREIGN PATENT DOCUMENTS 2628985 12/1977 Fed. Rep. of Germany .

*Primary Examiner*—John J. Vrablik
*Assistant Examiner*—Alfred Basichas
*Attorney, Agent, or Firm*—Seidel, Gonda, Lavorgna & Monaco

[57] ABSTRACT

A reciprocating pump which substantially eliminates cavitation problems without imposing capacity and flow limitations to maintain a net positive suction head. The pump comprises a cylinder having a liquid inlet and a liquid outlet, a piston reciprocably movable within the cylinder and generally intermediate the liquid inlet and liquid outlet, the piston having a liqud flow conduit therethrough generally co-axial with the cylinder, the liquid flow conduit having an inlet end in liquid communication with the cylinder liquid inlet and an outlet end in liquid communication with the cylinder liquid outlet, a piston rod reciprocably movable generally along the axis of the cylinder for reciprocably moving the piston within the cylinder in a direction toward the cylinder liquid outlet and in a reciprocal direction and a valve operatively associated with an intermediate the piston rod and the piston liquid flow conduit inlet end for alternatively opening and closing the inlet to liquid flow, the valve being closed when the piston rod and piston are moved in the direction toward the cylinder liquid outlet and being open when the piston rod and piston are moved in the reciprocal direction. In one embodiment, the valve comprises a valve disk freely movable on one end of the piston rod.

11 Claims, 3 Drawing Sheets

SATURATED FLUID PUMPING APPARATUS

TECHNICAL FIELD

The present invention relates to the technical field of mechanical apparatus for pumping liquids and, in particular, to pumps for saturated or near saturated liquids.

BACKGROUND ART

The term "saturated liquid" is used in this application to describe a liquid at its exact boiling point for a corresponding vapor pressure. A common situation which involves pumping saturated liquids occurs where the gas is the vapor phase of the liquid substance. Either a decrease of the pressure or an increase in the temperature will vaporize some of the liquid until a new boiling point equilibrium at a new vapor pressure is reached. This situation is found in the storage and transportation of cryogenic liquids, which exist in gaseous phase at normal ambient temperatures and pressures, but can be stored and transported in well-insulated low temperature containers in their liquid state, thus drastically reducing their volume without need for increasing the pressure. Liquid elements such as hydrogen, oxygen or nitrogen and liquified hydrocarbons such as methane or natural gas are common examples of cryogenic liquids.

Reciprocating pumps are frequently used to move such cryogenic fluids between containers or to any other point of use. With the conventional pumps of the prior art, it has been found necessary to maintain a net positive suction head (NPSH) to prevent cavitation within the pump. Net positive suction head (NPSH) is the required additional pressure above the saturation vapor pressure of the liquid at any given temperature. Cavitation is the formation of vapor-filled cavities within the liquid caused in areas of the pump where the pressure of the moving liquid drops below the saturation vapor pressure. It typically occurs at the inlet valve of the prior art pumps, as the initial opening of the valve allows liquid to be drawn into an evacuated chamber. The pressure drop associated with the accelerated liquid produces vapor cavities, which become trapped in the cylinder below the piston. As the piston moves down on the compression stroke, the liquid pressure is increased above its saturation vapor pressure and the vapor cavities instantly condense back into liquid. The collapsing cavities generally cause significant shock, vibration, noise, and rapid erosion of metal surfaces, all of which can damage the pump.

For brevity purposes, the remainder of this disclosure will refer only to saturated liquid or to a particular saturated liquid such as liquified natural gas. It should be understood that the invention likewise applies to near saturated liquids, which in the context of this application means a liquid sufficiently near saturation that cavitation is a potential problem when it is being pumped.

DISCLOSURE OF THE INVENTION

The present invention is a reciprocating pump which substantially eliminates cavitation problems without imposing capacity and flow limitations to maintain a net positive suction head. The pump comprises cylinder means having liquid inlet means and liquid outlet means, piston means reciprocably movable within the cylinder means and generally intermediate the liquid inlet means and liquid outlet means, the piston means having a liquid flow conduit therethrough generally co-axial with the cylinder, the liquid flow conduit having an inlet end in liquid communication with the cylinder means liquid inlet means and an outlet end in liquid communication with the cylinder means liquid outlet means, piston rod means reciprocably movable generally along the axis of the cylinder means for reciprocably moving the piston means within the cylinder means in a direction toward the cylinder means liquid outlet means and in a reciprocal direction, and valve means operatively associated with and intermediate the piston rod means and the piston means liquid flow conduit inlet end for alternately opening and closing the inlet to liquid flow, the valve means being closed when the piston rod means and piston means are moved in the direction toward the cylinder means liquid outlet means and being open when the piston rod means and piston means are moved in the reciprocal direction.

In a particular embodiment of the invention, the novel pump comprises a piston having a hollow conical bore which makes a close conforming fit over a conical discharge valve housing extending from the bottom of the cylinder when the piston reaches the bottom of its stroke. The top rim of the piston bore also serves as an inlet valve seat for an inlet valve disk which is completely opened by the piston rod before the piston begins to rise away from the bottom conical housing. As the piston begins to rise, it opens a pumping chamber between the piston bore and the bottom housing into which the saturated liquid smoothly flows under the gravitational force of the overlying fluid column. Any cavitation is thus largely eliminated, since the hollow piston is moving upward through the essentially static liquid, and if any minor liquid vaporization occurs, the resulting bubbles are allowed to migrate upward along the conical walls of the bore and out the still-open inlet valve, rather than to collapse in the pumping chamber.

The complete opening of the inlet valve prior to upward movement of the piston is accomplished by coupling the piston to the push rod by a cage means. Flanged posts extend upward from the piston in a cage arrangement surrounding the top end of the conical bore, and the post flanges are adapted to engage a circumferential flange on a valve disk which is attached to the push rod. Thus, the initial upward movement of the push rod lifts the valve disk to its fully open position while the piston itself remains seated over the conical housing in the cylinder. No evacuated chamber is created for the liquid to fill until the valve disk engages the cage and begins to raise the piston, at which time the inlet valve is completely open, thus eliminating the restrictive nozzle effect of cracking open an inlet valve to an evacuated chamber.

The valve disk is attached to the push rod by a ball joint which allows the disk to swivel into flat alignment over the top rim of the conical bore to effect a tight seal and eliminate wear caused by misalignment.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

BEST MODE FOR CARRYING OUT THE INVENTION

Figure 1:
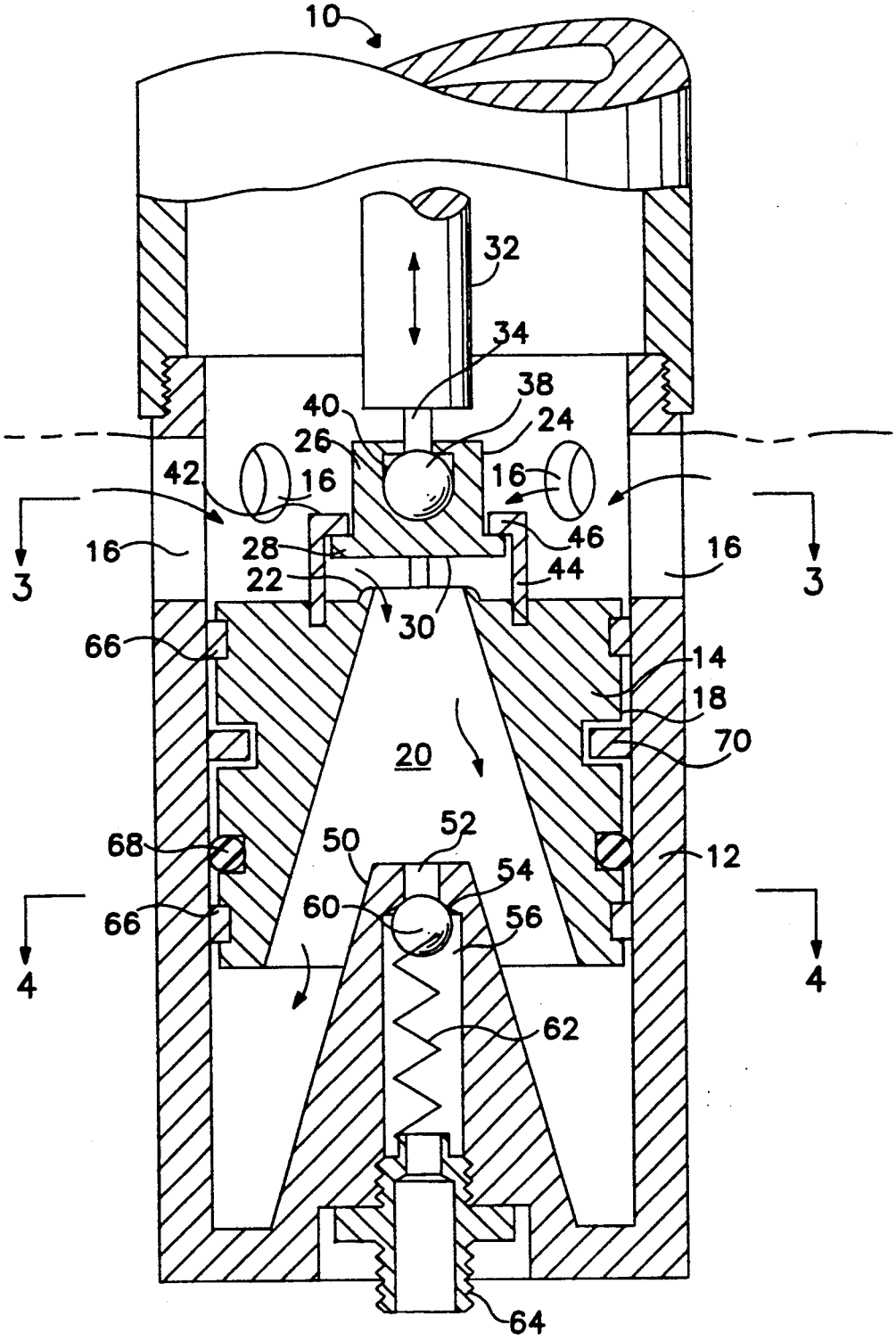
FIG. 1 is a partial section of such pump depicted at the top of its piston stroke.

FIG. 1 depicts a partial cross section of a preferred embodiment of a pump 10 submerged in a saturated liquid such as liquified natural gas (LNG). Those familiar with the storage and transport of LNG will understand, without drawings or detailed description, that the pump 10 will be located within a high pressure cryogenic tank needed to keep the material in a liquid state. The familiar reader will also understand that the pump 10 will be located within a cryogenic container needed to keep the material in a liquid state and with the cylinder submerged under the level of the liquid. The familiar reader will also understand that the pump 10 discharge port, described in greater detail below, will be associated with a transport line or distribution manifold to move the LNG to other tanks or to any other point of use. Since the configuration of such associated elements may vary, and no specific configuration is required, they are not depicted in the drawings.

Pump 10 is a positive displacement reciprocating pump comprising a cylinder 12 and reciprocating piston 14. The piston 14 is depicted at the top of its stroke in FIG. 1. A plurality of inlet openings 16 are evenly spaced around the upper circumference of the cylinder 12 to allow the liquid to flow into the cylinder above the piston 14.

The piston 14 is a cylindrical block 18 having a hollow frusto-conical bore 20 (hereafter "conical bore" for brevity) oriented with its base at the bottom of the block 18 and tapering to open at the top where the block 18 is raised in a circular boss 22 to provide a sealing seat for an inlet valve means 24.

The valve means 24 comprises a cylindrical stem 26 with a circumferential disk 28 at its base to provide a flat sealing face 30 which, when seated against the boss 22, closes the conical bore 20 to liquid passage. The stem 26 is coupled to a push rod 32 by a ball coupling comprising a short rod extension 34 terminating in a ball 38. The stem 26 has a hollow chamber 40 with hemispherical bottom sides conforming to the dimensions of the ball 38, and an opening through which the rod extension 34 passes to connect to the push rod 32. The stem 26 and disk 28 are thus permitted to swivel around the ball 38 to seek a flat seating of its sealing face 30 against the boss 22. The reader will understand that push rod 32 will be reciprocated by an appropriate engine and gearing to provide pumping power.

The absence of a rigid connection between the long push rod and the piston eliminates stresses which exist in other pumps due to machining, welding and assembly tolerances combined with distortions (uneven shrinkage) when cooled to cryogenic temperatures, which result in side loads on and an early failure of piston rings and seals. This "free floating" piston, however, centers itself within the cylinder bore without causing uneven side forces on the piston rings and seals.

The valve means 24 is operatively connected with the piston 14 by a cage 42 comprising multiple posts 44, each extending upward from the piston block 18 and having an inward facing flange 46 extending over the circumferential disk 28 of the valve stem 26. The cage 42 allows the valve disk 28 to open on the push rod upstroke with the piston remaining unmoved until the disk 28 engages the cage flanges 46; thereafter the piston is pulled up by the push rod to the top-of-stroke position depicted in FIG. 1. In this position, liquid flowing into the cylinder through the inlet openings 16 passes around the cage posts 44 and through the conical bore 20 to fill the portion of the cylinder below the piston, as indicated by the directional arrows in FIG. 1.

Figure 2:
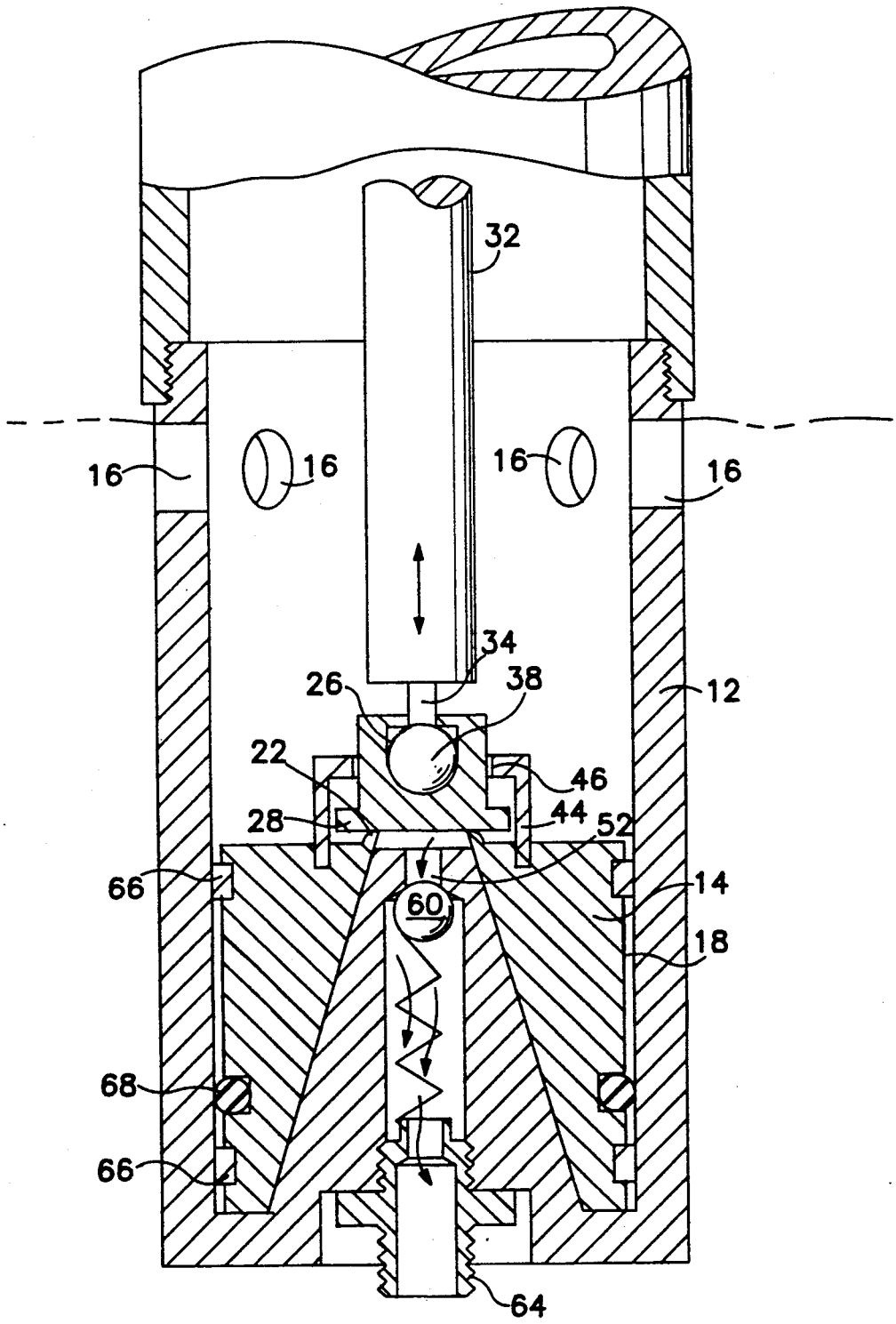
FIG. 2 is a partial section of such pump depicted at the bottom of its piston stroke.
Figure 3:
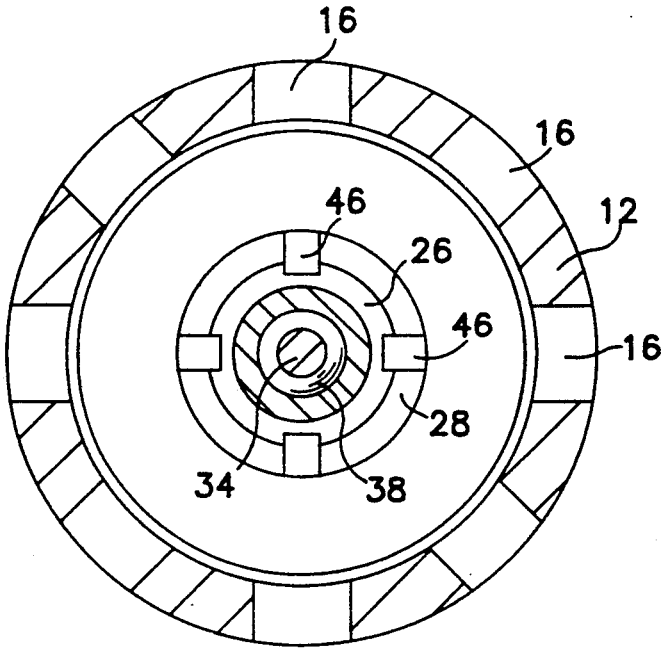
FIG. 3 depicts a section made along the line 3—3 of FIG. 1 in the direction indicated by the arrows.
Figure 4:
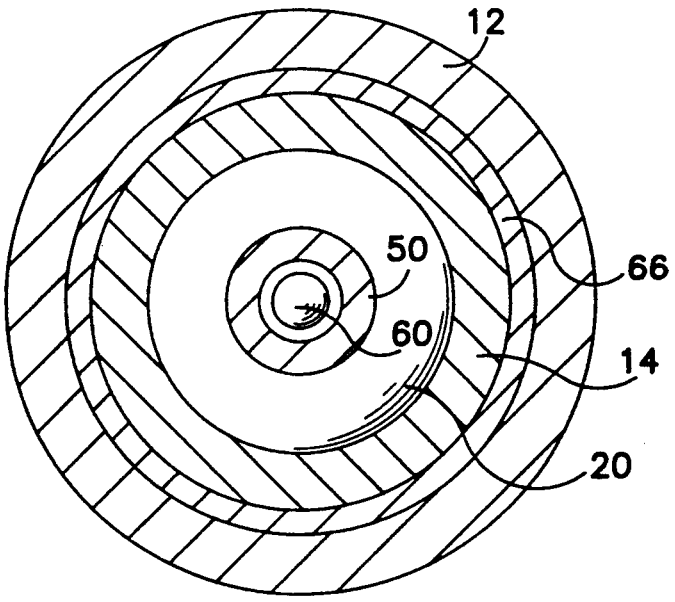
FIG. 4 depicts a section made along the line 4—4 of FIG. 1 in the direction indicated by the arrows.

The base of the cylinder 12 includes a frusto-conical valve housing 50 (hereafter "conical housing" for brevity) dimensioned to conform to the conical bore 20 such that, when the piston is at the bottom of its stroke, the conical housing 50 substantially fills the bore 20, as depicted in FIG. 2. Within the conical housing 50 is a discharge valve, comprising an outlet channel 52 opening to a wider channel 56 by a tapered intermediate section 54 which acts as a seat for a ball valve 60. A spring 62 pushes the ball valve 60 against seat to close the outlet channel. When the descending piston compresses the liquid trapped between the conical bore 20 and housing 50, the increased fluid pressure is transmitted to the ball valve 60 and compresses the spring 62 sufficiently to allow the trapped liquid to discharge through the outlet channel. A removable appropriate fitting 64 is provided for connecting the outlet channel to an appropriate transfer pipe.

The piston 14 also has conventional guide rings 66 and seal rings 68. If desired, a resilient "friction ring" 70, compatible with cryogenic service, can be provided which prevents the piston from sliding downward under its own weight before the valve disk "catches up" with the valve seat on the piston and builds up pressure in the pumping chamber.

The operating sequence of the pump 10 is apparent from the above description, but the reader should particularly consider the advantages this apparatus provides in pumping a saturated liquid without creating cavitation bubbles. Note first that the liquid flows into the top of the cylinder solely by the gravity induced pressure of the liquid column. When the piston is at the bottom of its stroke, the inlet valve is closed and a column of liquid sits on top of the piston, as shown in FIG. 2. The initial upward movement of the push rod opens the inlet valve but does not move the piston. When the piston begins to move upward, the only pressure differential is that created by the increased fluid velocity as the liquid falls through the conical bore into the cavity formed below. If any vapor bubbles do form, due to the heat of the piston seal friction, they will be allowed to escape up along the conical bore walls and out the inlet valve, since there is no place for bubbles to be trapped between the conical surfaces.

INDUSTRIAL APPLICABILITY

The described pump will have primary application in the cryogenic industry where the end use requires cryogenic liquids in low or moderate quantities but at a medium to very high pressures, and particularly where a net positive suction head is not available or difficult to attain, or where the pump is required to operate intermittently.

The present invention may be embodied in other specific forms without departing from the spirit or essential attributes thereof and, accordingly, reference should be made to the appended claims, rather than to the foregoing specification, as indicating the scope of the invention.

I claim:

1. A pump for saturated and near-saturated liquids, comprising:

cylinder means having liquid inlet means and liquid outlet means, piston means reciprocally movable within the cylinder means and generally intermediate the liquid inlet means and liquid outlet means, the piston means having a liquid flow conduit therethrough generally co-axial with the cylinder, the liquid flow conduit having an inlet end in liquid communication with the cylinder means liquid inlet means and an outlet end in liquid communication with the cylinder means liquid outlet means, piston rod means reciprocally movable generally along the axis of the cylinder means in a direction toward the cylinder means liquid outlet means and in a reciprocal direction, and inlet valve means operatively associated with and intermediate the piston rod means and the piston means liquid flow conduit inlet end comprising a valve disk freely movable on one end of the piston rod means, the valve disk alternately opening and closing the inlet end to liquid flow, the inlet valve closing said liquid flow conduit to liquid flow when the piston rod means moves said piston means in the direction toward the cylinder means liquid outlet means, and the inlet valve opening said conduit to liquid flow when the piston rod means is moved in the reciprocal direction.

2. A pump according to claim 1, further comprising seal means between the piston and the cylinder for dividing the cylinder into an inlet chamber and a discharge chamber.

3. A pump according to claim 1, wherein the valve means comprises a valve seat on the liquid flow conduit inlet end, a valve disk movably mounted on an end of the piston rod means for engaging the valve seat when the piston rod means is moved in the direction toward the cylinder means liquid outlet means and catch means on the piston means for engaging the valve disk when the piston rod means is moved in the reciprocal direction.

4. A reciprocating pump for saturated and near saturated liquids, comprising:

a cylinder, a piston disposed within the cylinder such that the sides of the piston conform to the side walls of the cylinder, a push rod coupled to the piston and to a reciprocating mover to reciprocate the piston in up and down strokes between top and bottom stroke positions, inlet means adapted to allow liquid to flow into the cylinder below the piston while the piston is moving from the bottom to the top stroke position, discharge means adapted to allow liquid to flow out of the cylinder while the piston is moving from the top to the bottom stroke position, said pump CHARACTERIZED BY:

the cylinder having a frusto-conical structure rising from the cylinder's interior bottom such that the structure's base is attached to the cylinder bottom and centered such that the conical axis is on the cylinder axis, the piston having passing through it a frusto-conical bore dimensioned and oriented to make a close conforming fit over the frusto-conical structure of the cylinder when the piston is at bottom stroke position, the inlet means comprises the frusto-conical bore and a valve disk attached to the push rod, such that valve disk is pushed against and closes the bore on the down stroke, and is lifted away from and opens the conical bore on the up stroke, and coupling means for coupling the push rod to the piston such that the piston does not move upward with the push rod from the bottom stroke position until the valve disk is lifted away from the conical bore a prescribed distance corresponding to a fully open condition of the inlet means.

5. A pump as in claim 4 further characterized by the coupling means comprising a cage structure attached to the piston and adapted to engage the valve disk when the push rod has risen the prescribed distance.

6. A pump as in claim 4 further characterized by the frusto-conical structure housing the discharge means.

7. A pump as in claim 5 further characterized by the frusto-conical structure housing the discharge means.

8. A pump as in claim 4, further characterized by the valve disk being attached to the push rod by a ball joint which is adapted to allow the disk to swivel to effect a tight seal over the bore.

9. A pump as in claim 5, further characterized by the valve disk being attached to the push rod by a ball joint which is adapted to allow the disk to swivel to effect a tight seal over the bore.

10. A pump as in claim 6, further characterized by the valve disk being attached to the push rod by a ball joint which is adapted to allow the disk to swivel to effect a tight seal over the bore.

11. A pump as in claim 7, further characterized by the valve disk being attached to the push rod by a ball joint which is adapted to allow the disk to swivel to effect a tight seal over the bore.

* * * * *